US011642808B1

(12) United States Patent
Bottone, III

(10) Patent No.: US 11,642,808 B1
(45) Date of Patent: May 9, 2023

(54) DRINK CONTAINER PIERCING DEVICE

(71) Applicant: Louis G. Bottone, III, Barnegat, NJ (US)

(72) Inventor: Louis G. Bottone, III, Barnegat, NJ (US)

( * ) Notice: Subject to any disclaimer, the term of this patent is extended or adjusted under 35 U.S.C. 154(b) by 0 days.

(21) Appl. No.: 17/581,167

(22) Filed: Jan. 21, 2022

(51) Int. Cl.
*B26F 1/32* (2006.01)
*B65D 25/48* (2006.01)

(52) U.S. Cl.
CPC ..... *B26F 1/32* (2013.01); *B65D 25/48* (2013.01)

(58) Field of Classification Search
CPC ..... B26F 1/32; B26F 1/382; B26F 1/2826; B26F 2210/00; B65D 25/48; B65D 51/226; B65D 51/227
USPC ..... 222/83, 80.88; 30/366, 367, 402, 443, 30/358
See application file for complete search history.

(56) References Cited

U.S. PATENT DOCUMENTS

| | | | | |
|---|---|---|---|---|
| 497,698 | A | 5/1893 | Weston | |
| 987,355 | A | 3/1911 | Godwin | |
| 1,498,301 | A | 6/1924 | Saari et al. | |
| 1,680,876 | A | 8/1928 | Guerris | |
| 2,338,592 | A | 1/1944 | Lorenzen | |
| 2,595,653 | A | 5/1952 | Fuller | |
| 2,620,558 | A * | 12/1952 | Bergeron | B67B 7/24 30/443 |
| 2,943,389 | A | 7/1960 | Dubois | |
| 3,605,263 | A | 9/1971 | Simmonds | |
| 4,408,690 | A * | 10/1983 | Ferrero | B65D 77/24 215/388 |
| D292,770 | S | 11/1987 | Scurto | |
| 6,364,170 | B1 | 4/2002 | Anderson et al. | |
| D661,327 | S | 6/2012 | Wiltsie | |
| 8,387,264 | B1 | 3/2013 | Pritchard | |
| 9,333,668 | B1 | 5/2016 | Goddard | |
| 2006/0042101 | A1 | 3/2006 | Roefs | |
| 2006/0236552 | A1* | 10/2006 | Giles | B67B 7/20 30/367 |
| 2014/0250700 | A1* | 9/2014 | Liotta | B26F 1/32 30/366 |
| 2015/0251330 | A1* | 9/2015 | Garcia | B26F 1/32 30/358 |

(Continued)

FOREIGN PATENT DOCUMENTS

| | | |
|---|---|---|
| KR | 101427897 | 8/2014 |
| KR | 101903890 | 9/2018 |

*Primary Examiner* — Lien M Ngo
(74) *Attorney, Agent, or Firm* — Goldstein Law Offices, P.C.

(57) ABSTRACT

A drink container piercing device for preparing a drink container with a cap to accept a drinking straw, the device having a device body adapted to be held in a user's hand, and a piercing assembly with a central projection and an arcuate blade. The piercing assembly is adapted to pierce the cap and create circular aperture via rotational cutting by the arcuate blade centered around the central projection. The arcuate blade produces a circular cut portion from the cap, which is removed to reveal a circular aperture for accepting the drinking straw. The cut portion is retained by the central projection, preventing the cut portion from falling into the container. The piercing assembly is retractable to prevent accidental contact with the arcuate blade, and the device body has finger projections to allow the user to stabilize the device when in use.

18 Claims, 10 Drawing Sheets

(56) References Cited

U.S. PATENT DOCUMENTS

2018/0044064 A1 2/2018 Clarke et al.
2018/0334371 A1* 11/2018 Trench ..... B67B 7/24

* cited by examiner

DRINK CONTAINER PIERCING DEVICE

TECHNICAL FIELD

The present disclosure relates generally to a device and method for preparing a drink container to accept a drinking straw. More particularly, the present disclosure relates to a drink container piercing device.

BACKGROUND

Drinking water and beverages are commonly distributed in containers with removable caps, typically formed of plastic. For a user to consume the contents of such containers, it is necessary to remove the cap from the container, allowing the contents to be poured out of the container opening, or be accessed through a drinking straw inserted through the opening. However, removal of the cap creates an increased risk of spillage if the container is overturned or otherwise upset. Furthermore, if the cap is misplaced or discarded, the container cannot be recapped for later consumption. This frequently results in the container with partially consumed contents being wastefully thrown away.

A need therefore exists for a handheld device which allows a user to pierce the cap of a container to create an opening through which the drinking straw is inserted and secured. Such a device would be comfortable and stable in the user's hand, and have a safe, retractable tip for piercing the cap which is operable using either the user's thumb or palm.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a device for preparing a drink container to receive a drinking straw, the drink container having a container body, a container interior with contents, and a cap with a cap top. Accordingly, the present disclosure provides a drink container piercing device comprising a device body with a device body first end and a device body second end, and a piercing assembly disposed at the device body first end having a central projection and an arcuate blade. The arcuate blade is curved, and is adapted to pierce the cap top and cut the cap top in a rotational manner centered around the central projection, to produce a circular aperture in the cap top which reveals the container interior. The drinking straw is then inserted through the circular aperture to allow the user or another person to access the contents.

It is another aspect of an example embodiment in the present disclosure to provide a device which pierces the cap without causing any pieces of the cap to fall into the container interior. Accordingly, the arcuate blade produces a circular cut portion, and the central projection is adapted to retain the circular cut portion as the piercing assembly is withdrawn from the cap top, thereby preventing the cut portion from falling into the container interior.

It is yet another aspect of an example embodiment in the present disclosure to provide a device which prevents accidental contact with the piercing assembly when the device is not in use. Accordingly, the device body has an interior channel, and the piercing assembly is held within the interior channel in a retracted position. The piercing assembly is advanced to an extended position when in use, causing the central projection and the arcuate blade to project outwardly past the device first end.

It is a further aspect of an example embodiment in the present disclosure to provide a device which is held by a user's hand in a stable manner. Accordingly, the device body has a first finger projection and a second finger projection, and a pushrod which advances the piercing assembly. The user places a finger against each of the first and second finger projections, and places a palm or thumb against the pushrod.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1A:
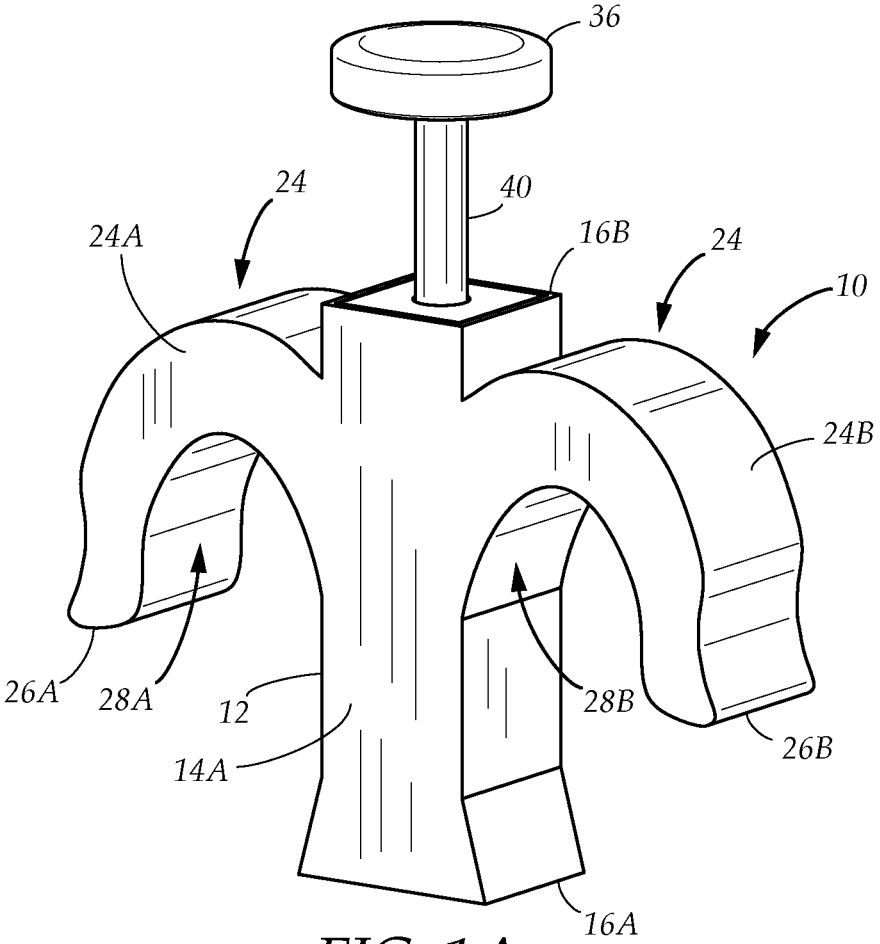
FIG. 1A is a diagrammatic perspective view of a drink container piercing device showing a device body and a pair of finger supports, in accordance with an embodiment in the current disclosure.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

FIGS. 1A-1B, and FIGS. 11A-11B illustrate a drink container piercing device 10 with a piercing assembly 48, for use with a drink container 100 having a cap 104, a container body 102, and a container interior 103 within the container body 102. The piercing assembly 48 of the drink container piercing device 10 is adapted to pierce the cap 104 and create a circular aperture 116 thereon which provides access to the container interior 103, further allowing a drinking straw 114 to be inserted through the circular aperture 116 into the container interior 103. The drinking straw 114 is a tube formed of plastic, metal, paper, or other suitable material, and has a straw first end 114A and a straw second end 114B. To minimize spillage of the contents, the circular aperture 116 may be formed with a diameter which substantially matches a diameter of the drinking straw 114.

The container 100 represents a bottle, jar, or other apparatus used to store contents within the container interior 103, corresponding to water, beverages, or other consumable liquids. The container body 102 has a container upper portion 102A and a distally oriented container lower portion 102B, and the container interior 103 is disposed therebetween. The cap 104 covers the container upper portion 102A, and blocks access to the container interior 103.

Figure 7A:
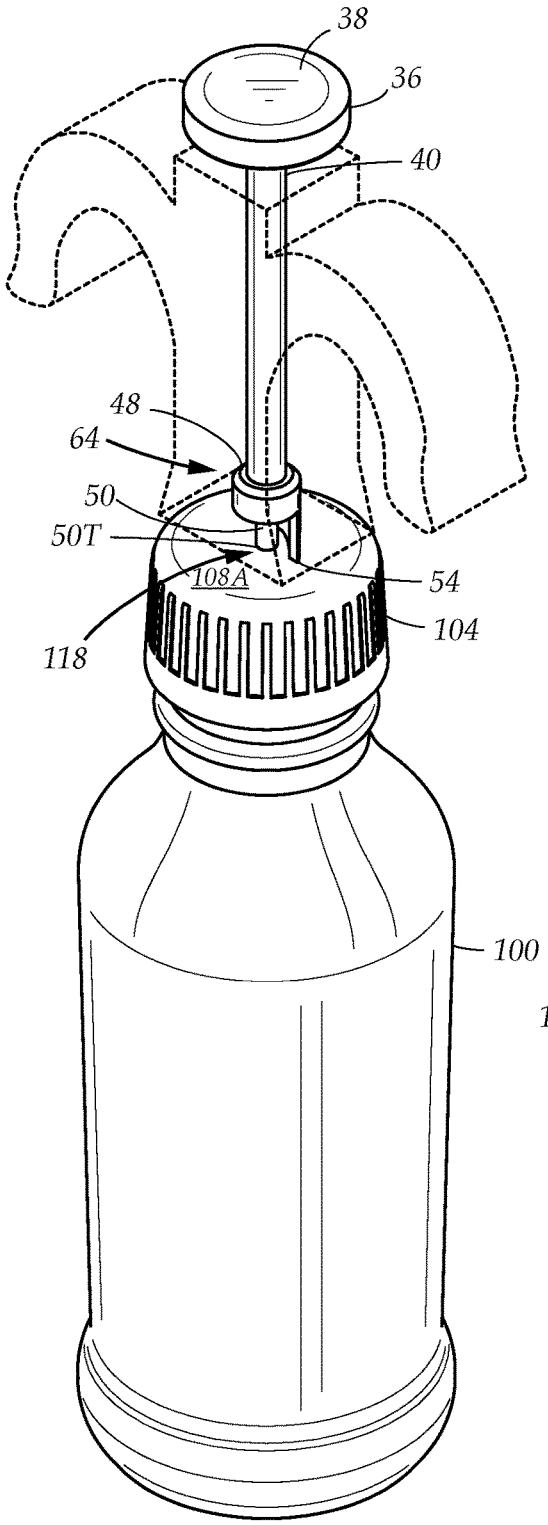
FIG. 7A is a diagrammatic perspective view showing the pushrod and piercing assembly lowered to the extended position, allowing the piercing assembly to penetrate the cap, in accordance with an embodiment in the current disclosure.
Figure 7B:
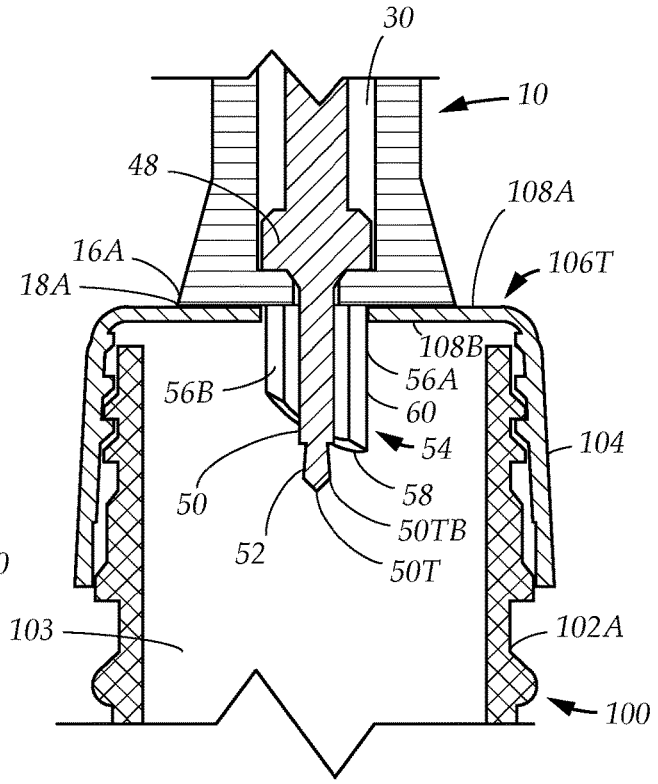
FIG. 7B is a cross section view of the drink container piercing device and the container, showing the arcuate blade and the piercing tip extending past the cap top surface and into a container interior, in accordance with an embodiment in the current disclosure.
Figure 11A:
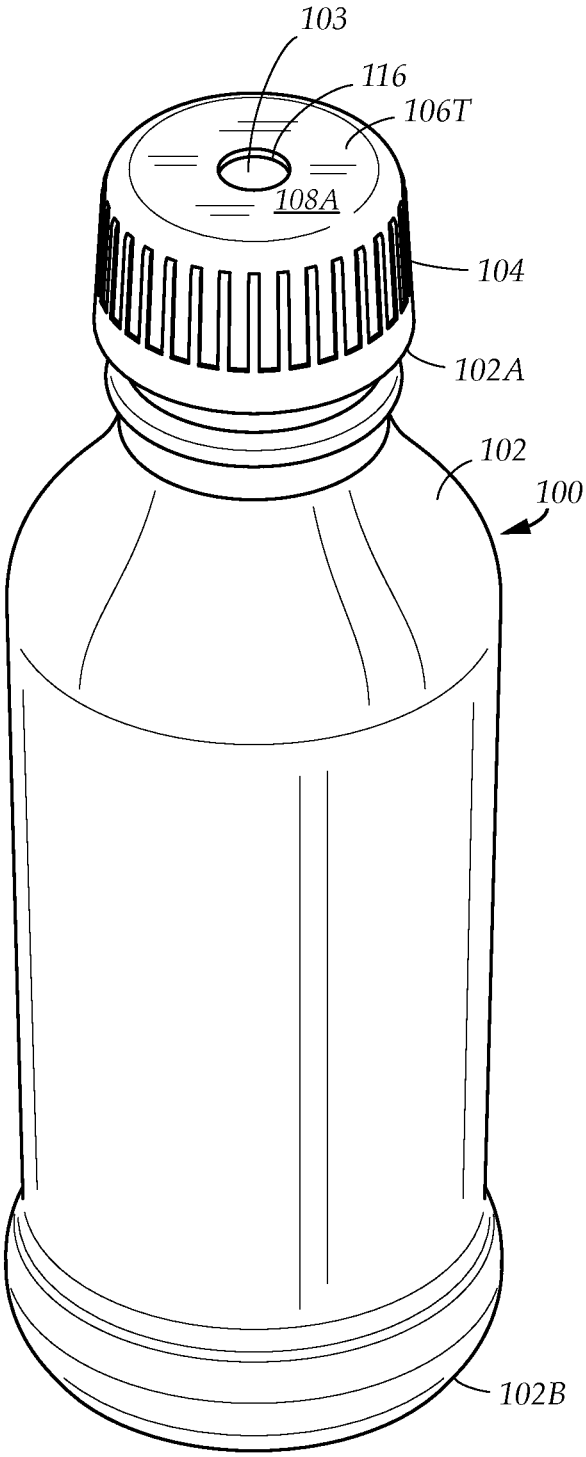
FIG. 11A is a diagrammatic perspective view of the container, showing the circular aperture in the cap which provides access to the container interior, in accordance with an embodiment in the current disclosure.

Turning briefly to FIG. 7B while continuing to refer to FIG. 11A, the cap 104 has a substantially flat cap top 106T with a cap top outer face 108A, and a cap top inner face 108B disposed inwardly towards the container interior 103. The container body 102 may be formed of plastic, metal, glass, or other material, while the cap 104 may be formed of a material such as plastic which is sufficiently soft to allow the cap 104 to be pierced or cut by a user operating the drink container piercing device using hand strength.

Figure 1B:
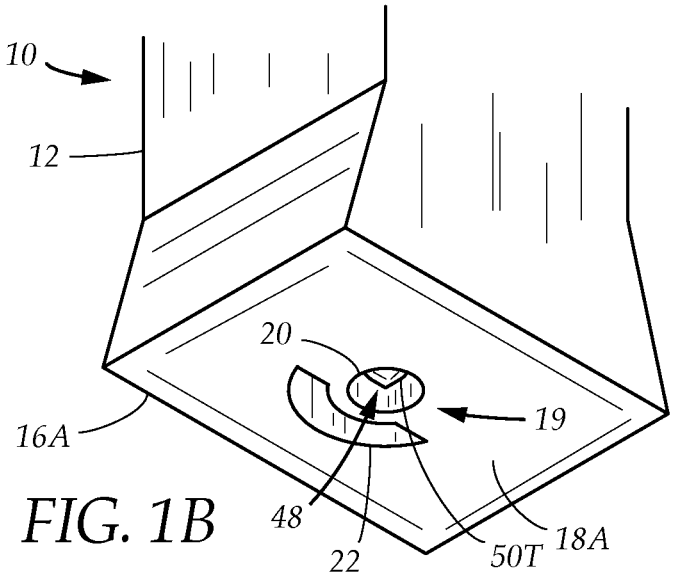
FIG. 1B is a diagrammatic perspective view of the drink container piercing device viewed from below, showing a first surface disposed at a first end of the device body, with a first aperture and a second aperture disposed on the first surface, in accordance with an embodiment in the current disclosure.
Figure 2:
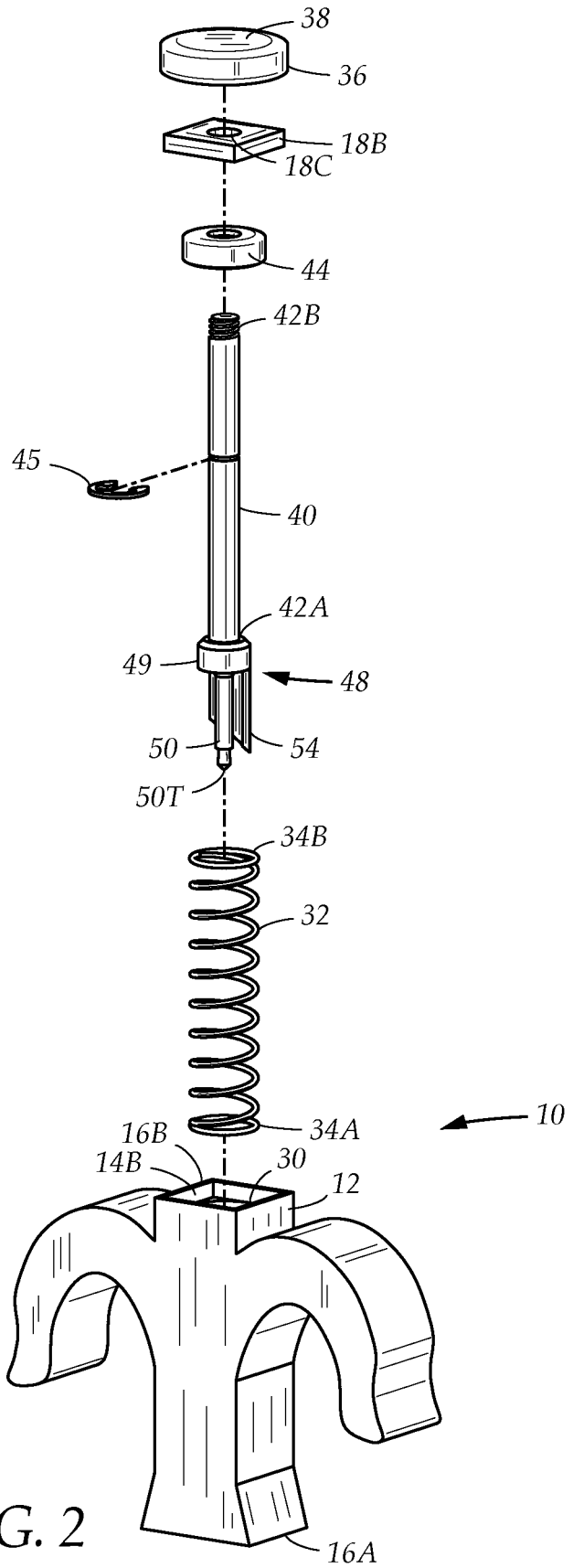
FIG. 2 is an exploded view of the drink container piercing device, showing a pushrod and piercing assembly with an arcuate blade and a central projection, further showing a retraction spring and a spring stop flange, the pushrod and the piercing assembly are aligned with an interior channel disposed in the device body, in accordance with an embodiment in the current disclosure.

Turning to FIGS. 1A-B and FIG. 2, the drink container piercing device 10 comprises a device body 12 having a device body first end 16A, a distally oriented device body second end 16B, and an outer surface 14A extending therebetween. In a preferred embodiment, the device body 12 further has a first surface 18A positioned at the device body first end 16A. The first surface 18A is substantially flat, and is oriented perpendicularly across the device body first end 16A. The piercing assembly 48 is positioned closer to the device body first end 16A than the device body second end 16B, and comprises an arcuate blade 54 and a central projection 50 with a piercing tip 50T. The piercing assembly 48 is configured such that the arcuate blade 54 and the piercing tip 50T project outwardly away from the first surface 18A. The arcuate blade 54 and the central projection 50 are formed of a material with high hardness suitable for use with cutting implements, such as steel, another suitable metal, a ceramic, or other material which will be known to a person of ordinary skill in the art in the field of the invention.

Turning to FIG. 1B, FIGS. 3A-B, and FIGS. 4A-B while continuing to refer to FIG. 2, in one embodiment, the device body 12 is partially hollow, and further has an inner surface 14B opposite the outer surface 14A which defines an interior channel 30 extending from the device body first end 16A towards the device body second end 16B. The interior channel 30 allows the piercing assembly to retract to a retracted position 62, causing the arcuate blade 54 and the central projection 50 to withdraw inwardly past the device body first end 16A and the surface 18A, thus preventing inadvertent or accidental contact therewith when the drink container piercing device 10 is not in use. The piercing assembly 48 is further configured to advance from the retracted position 62 into an extended position 64, causing the central projection 50 and the arcuate blade 54 to extend outwardly beyond the device body first end 16A and the first surface 18A. The first surface 18A has at least one access aperture 19 which allows the central projection 50 and the arcuate blade 54 to withdraw into, or extend out of, the interior channel 30. In one embodiment, the at least one access aperture 19 further includes a first aperture 20 and a second aperture 22. The central projection 50 and the arcuate blade 54 are positioned to extend outwardly or retract inwardly through the first aperture 20 and the second aperture 22 respectively. The second aperture 22 has a curved shape to allow the arcuate blade 54 to pass therethrough.

In a preferred embodiment, the drink container piercing device 10 further has a retraction spring 32 positioned within the interior channel 30 which exerts a retracting force which pushes the piercing assembly 48 inwardly towards the device body second end 16B. The piercing assembly 48 remains in the retracted position 62 unless the retracting force is overcome. In one embodiment, the retraction spring 32 may be a coiled compression spring having a spring first end 34A and a spring second end 34B. The spring first end 34A may be oriented towards the device body first end 16A, while the spring second end 34B may be oriented towards the device body second end 16B. In certain embodiments, the device body 12 may have a spring rest surface 46 projecting inwardly toward the interior channel 30. The spring first end 34A may abut against the spring rest surface 46.

In one embodiment, the piercing assembly 48 has a pushrod 40 which is positioned within the interior channel 30 and passes centrally through the retraction spring 32. The pushrod 40 has a pushrod first end 42A which is connected to the piercing assembly 48, and a distally oriented pushrod second end 42B which extends away from the piercing assembly 48 and projects outwardly away from the device body second end 16B. The device body 12 may have a second surface 18B with a pushrod channel 18C disposed at the device second end 16B, allowing the pushrod second end 42B to pass through the pushrod channel 18C.

The pushrod 40 may also have a spring stop 44 positioned between the pushrod first end 42A and the pushrod second end 42B. The spring second end 34B abuts against the spring stop 44, allowing the retracting force to be applied against the pushrod 40. The retracting force thus causes the pushrod 40 and the piercing assembly 48 to withdraw away from the device body first end 16A, and places the piercing assembly 48 in the retracted position 62.

In one embodiment, the spring stop 44 is configured as a flattened cylinder or disk with a central channel through which the pushrod 40 extends. The spring stop 44 is secured to the pushrod 40 within the interior channel 30, between the piercing assembly 48 and the device body second end 16B. In one embodiment, the spring stop 44 is capable of sliding along the pushrod 40, and a spring stop block 45 is attached to the pushrod 40 between the spring stop 44 and the pushrod second end 42B. The spring stop block 45 may be a crescent shaped retaining ring or other component attached to the pushrod 40, which prevents the retracting force exerted by the retraction spring 32 from displacing the spring stop 44 upwardly beyond the spring stop block 45.

The user may cause the piercing assembly 48 to enter the extended position 64 by applying an advancing force to the pushrod second end 42B towards the device body first end 16A. The advancing force overcomes the retracting force, and the pushrod 40 causes the central projection 50 and the arcuate cutting blade 54 to project outwardly past the device body first end 16A. To facilitate application of the advancing force, the pushrod 40 may have an actuation support 36 positioned at the pushrod second end 42B. The actuation support 36 has a support surface 38 against which the user's palm, thumb, or other finger may be placed, thus allowing the user to comfortably apply force against the pushrod 40. The actuation support 36 may be configured as a knob, cylinder, curved thumb rest, or other suitable structure for supporting the hand or finger.

Referring to FIG. 1A while also referring to FIGS. 3A-B and FIGS. 4A-B, in a preferred embodiment, the device body 12 also has a pair of finger supports 24 which allow the user to stabilize the drink container piercing device 10 in the user's hand. The pair of finger supports 24 comprise a first finger support 24A and a second finger support 24B which each project laterally away from the outer surface 14A of the device body 12. The user may grasp the drink container piercing device 10 by placing the palm or the thumb upon the actuation support 36 of the pushrod 40, while also placing one finger in contact with each of the finger supports 24. While applying the advancing force downwardly against the pushrod 40, the user simultaneously pushes upwardly against the first and second finger supports 24A, 24B using the fingers in contact therewith.

Furthermore, the first finger support 24A may have a first projection 26A while the second finger support 24B may have a second projection 26B. The first projection 26A and the second projection 26B extend away from the first finger support 24A and the second finger support 24B respectively, and project downwardly towards the device body first end 16A. The first finger support 24A, the first projection 26A, and the device body 12 define a first retaining space 28A, while the second finger support 24B, the second projection 26B, and the device body 12 define a second retaining space 28B. By placing a finger in each of the first and second retaining spaces 28A, 28B, the user is able to exercise increased control over the drink container piercing device 10 while also preventing the fingers from slipping off the first or second finger supports 24A, 24B.

Note that in an alternate embodiment, the finger supports 24 may be omitted from the drink container piercing device 10, and the user may grasp the device body 12 directly between the palm and the fingers while using the thumb to apply the advancing force against the pushrod 40.

Figure 10:
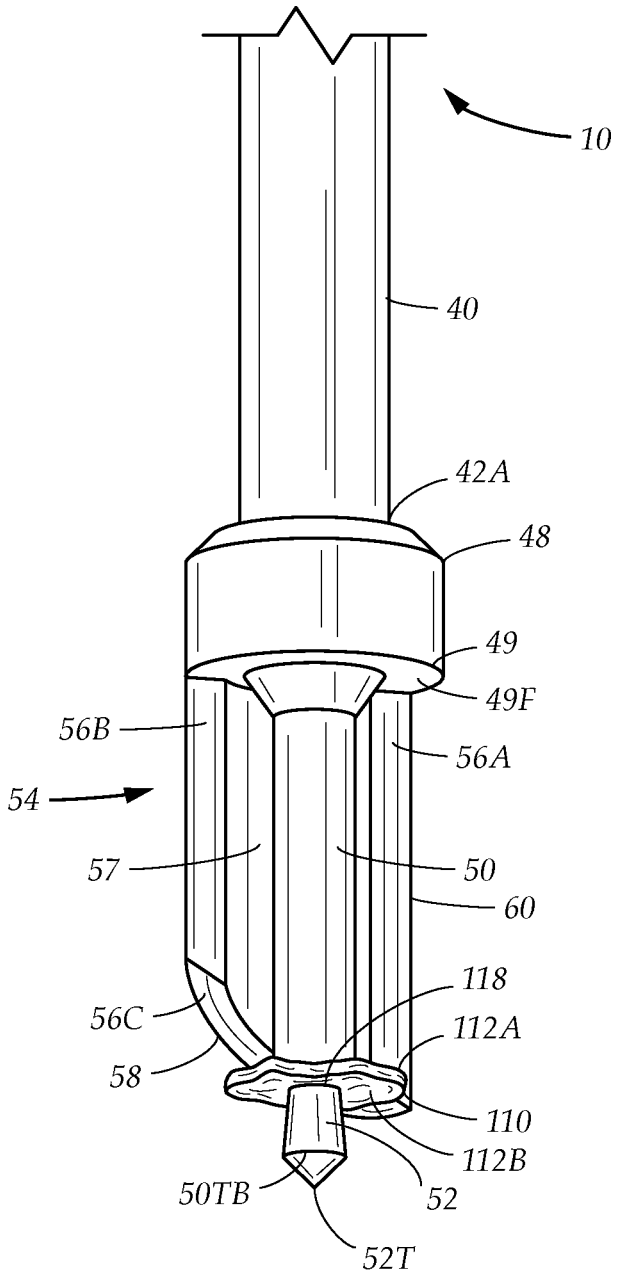
FIG. 10 is a diagrammatic perspective view of the piercing assembly, showing the cut portion attached to the central projection near the piercing tip, in accordance with an embodiment in the current disclosure.

Turning to FIG. 10 while also referring to FIG. 1A and FIG. 2, in one embodiment, the piercing assembly 48 has a head 49 with an outer face 49F from which the central projection 50 and the arcuate blade 54 extend. The head 49 may be a flange, block, or cylinder with a flat surface forming the outer face 49F. In a preferred embodiment, the outer face 49F is circular, and the central projection 50 is located centrally upon the outer face 49F, arranged coaxially with the pushrod 40. The central projection 50 may be a rod which is square, polygonal, or circular in shape. The central projection 50 terminates in the piercing tip 50T, and the piercing tip 50T may be conical or pyramidal in shape.

The central projection 50 has a piercing tip base portion 50TB positioned between the piercing tip 50T and the head 49. The piercing tip has a diameter which is narrowest at the piercing tip, and gradually widens towards the base portion 50TB. The central projection 50 further has an extraction surface 52 disposed between the base portion 50TB and the head 49, and which is oriented away from the piercing tip 50T towards the outer face 49F. In one embodiment, the extraction surface 52 is tapered, and has a diameter which gradually diminishes from the base portion 50TB towards the head 49. In other embodiments, in lieu of the tapered configuration, the extraction surface 52 may be substantially flat. In a preferred embodiment, the piercing tip 50T projects further from the head 49 than the arcuate blade 54.

The arcuate blade 54 has a curved aspect, and is configured to cut in a rotational manner centered around the central projection 50. The arcuate blade 54 is capable of cutting in both a horizontal direction and a vertical direction. In a preferred embodiment, the arcuate blade 54 has a first side 56A, a second side 56B, a third side 56C, and a blade surface 57. The first and second side 56A, 56B extend from the head 49 of the piercing assembly 48, and are substantially parallel. The third side 56C is located distally in relation to the head 49, and extends between the first and second sides 56A, 56B.

The blade surface 57 is curved, and extends between the first, second, and third sides 56A, 56B, 56C, and the head 49. The arcuate blade 54 has a first blade edge 58 positioned along the third side 56C, and a second blade edge 60 positioned along the first side 56A. The first blade edge 58 is configured to cut in the vertical direction, while the second blade edge 60 is configured to cut in the horizontal direction. In a preferred embodiment, the first side 56A has a length which is greater than a length of the second side 56B, thus causing the first blade edge 58 to slope angularly from the first side 56A towards the second side 56B.

Figure 5:
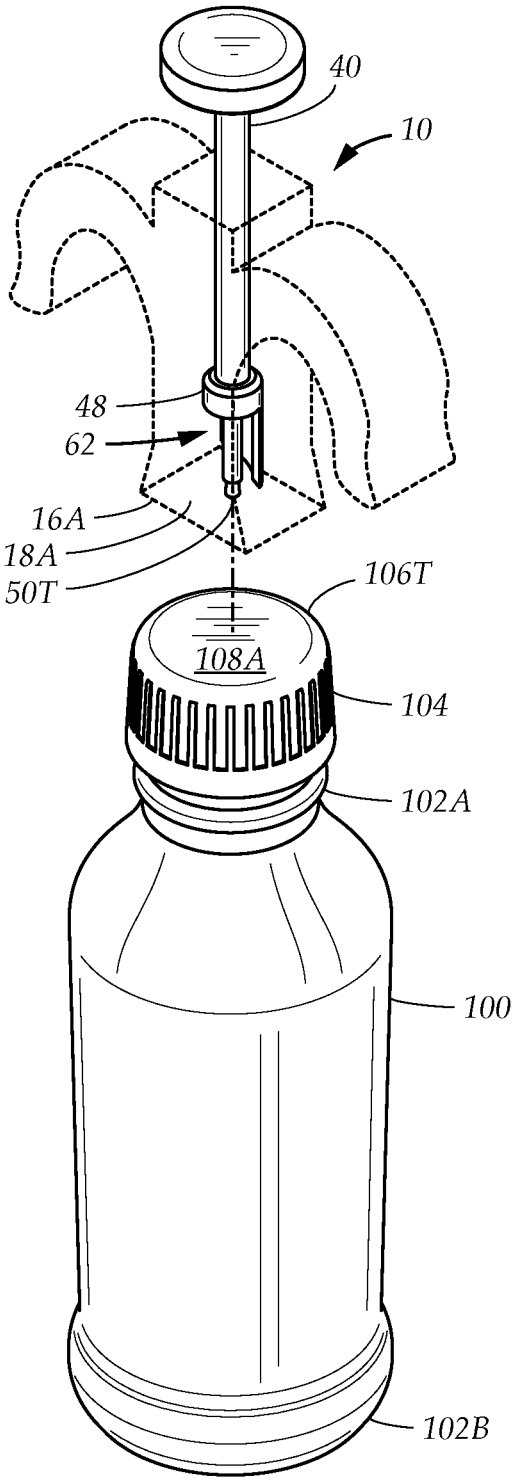
FIG. 5 is a diagrammatic perspective view of a drink container with a cap and a cap top surface, further showing the drink container piercing device in alignment with the cap, in accordance with an embodiment in the current disclosure.
Figure 6:
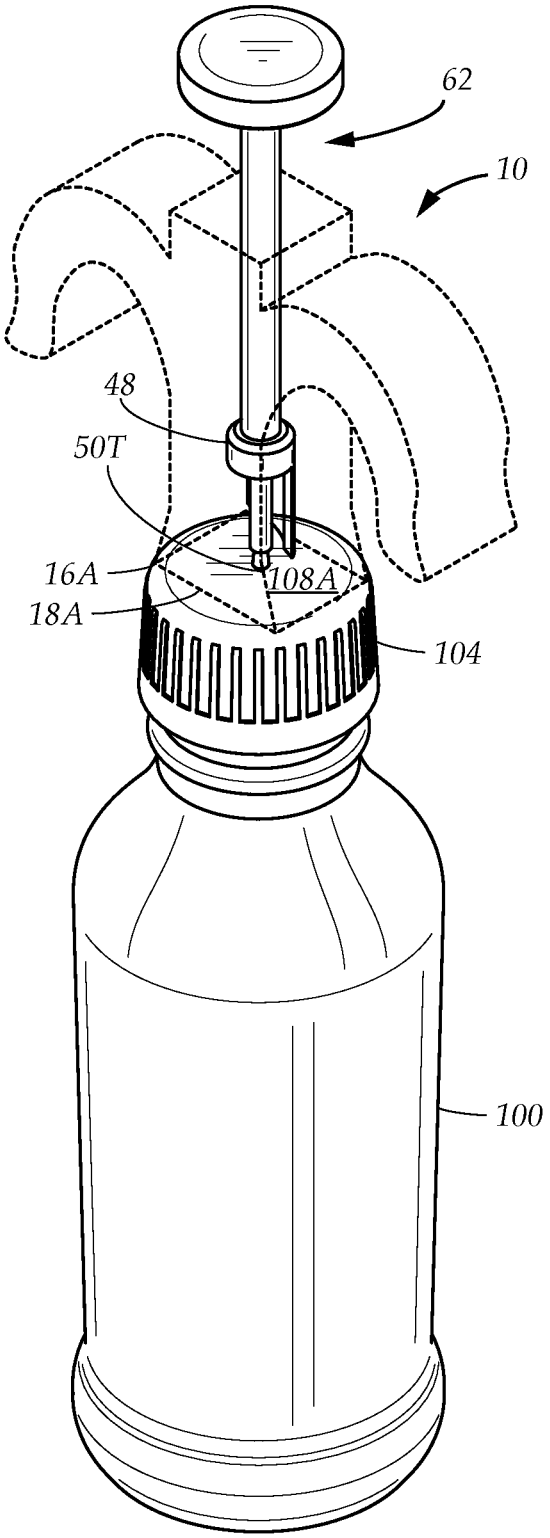
FIG. 6 is a diagrammatic perspective view showing the drink container piercing device lowered to create a contact between the first surface of the device body and the cap top surface, in accordance with an embodiment in the current disclosure.

Turning to FIGS. 5-6, the user may utilize the drink container piercing device 10 by first grasping the device 10 and then aligning the device body first end 16A with the cap 104 of the container 100. The user then places the first surface 18A in contact with the cap top outer face 108A. At this point, the piercing assembly 48 is the retracted position 62.

Figure 4A:
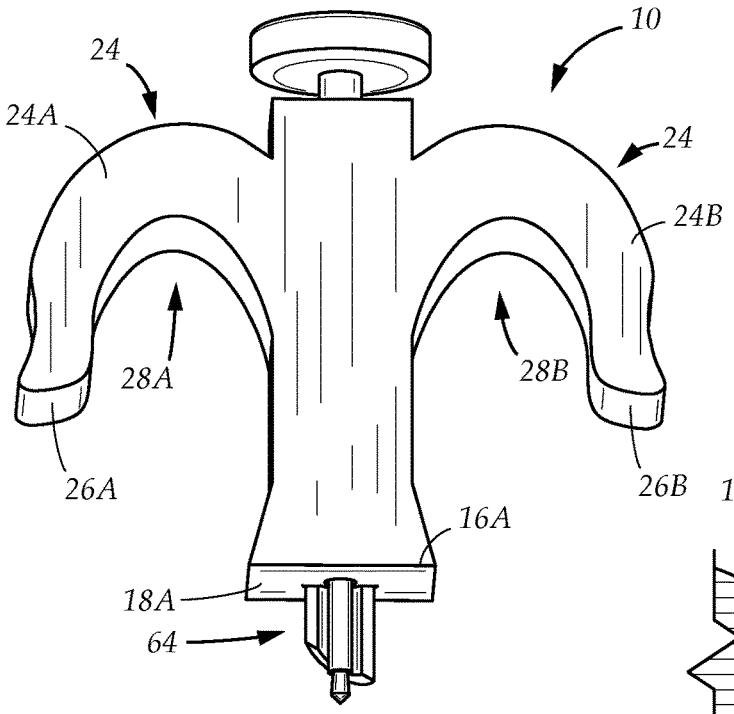
FIG. 4A is a diagrammatic perspective view of the drink container piercing device, showing an actuation support attached to the pushrod for assisting a user in pushing the pushrod and piercing assembly towards an extended position, in accordance with an embodiment in the current disclosure.
Figure 4B:
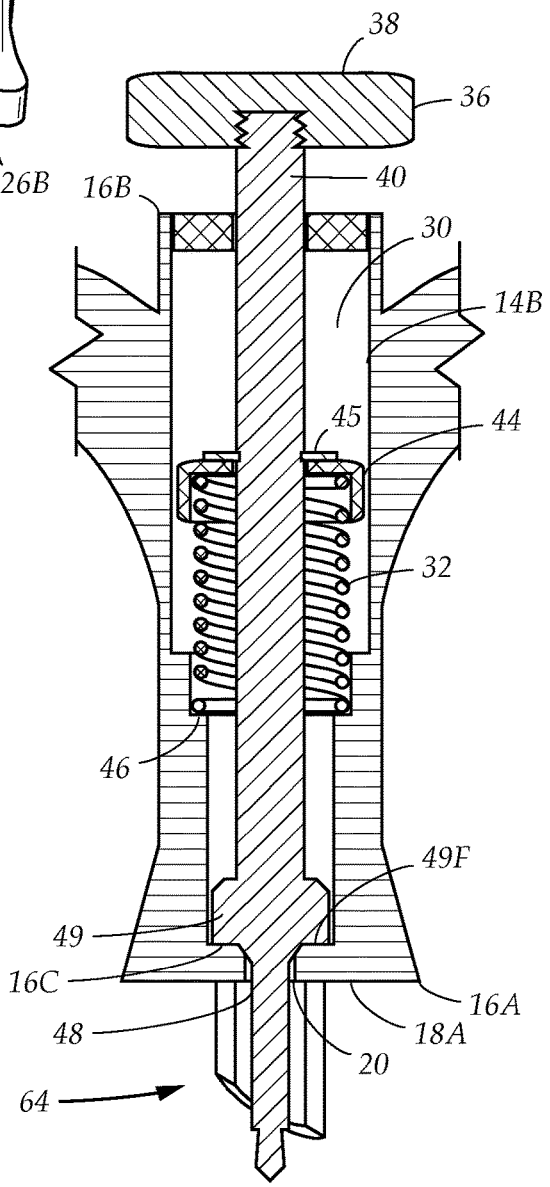
FIG. 4B is a cross sectional view of the drink container piercing device, showing the pushrod and the piercing assembly in the extended position causing the central projection and the cutting blade to protrude outwardly past the first surface of the device body, in accordance with an embodiment in the current disclosure.

Turning to FIGS. 7A-B while also referring to FIG. 4B, the user then exerts an advancing force upon the actuation support 36 of the pushrod 40 which overcomes the retraction spring 32 and causes the piercing assembly to enter the extended position 64. The piercing tip 50T of the central projection 50 and the arcuate blade 54 advance downwardly past the first surface 18A, and penetrate the cap top 106T of the cap 104. The piercing tip 50T creates a piercing point 118 through the cap top 106T, allowing the central projection 50, the piercing tip base 50TB, and the extraction surface 52 to extend past the cap top inner face 108B and into the container interior 103.

Figure 8:
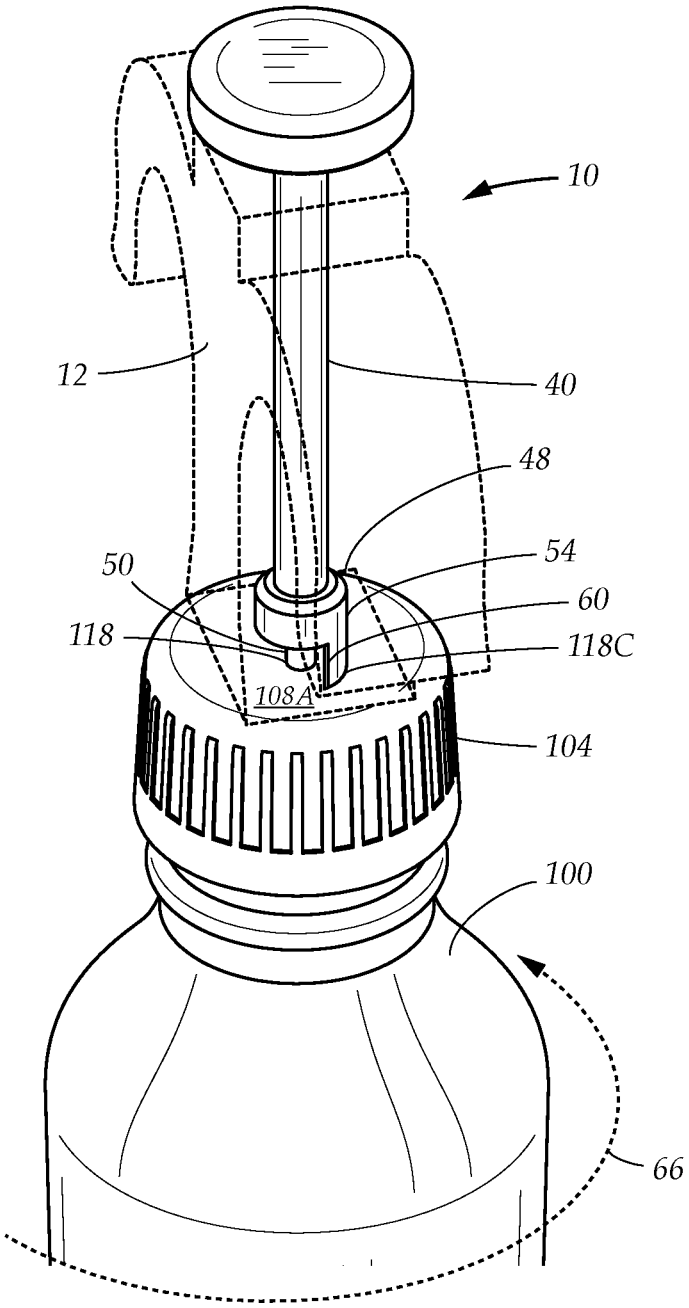
FIG. 8 is a diagrammatic perspective view showing the container being rotated in relation to the drink container piercing device, causing the arcuate blade to cut horizontally across the cap, in accordance with an embodiment in the current disclosure.

Turning to FIG. 8 while also referring to FIG. 4B and FIG. 7B, the first blade edge 58 of the arcuate blade 54 penetrates the cap top 106T from the vertical direction, extends past the cap top inner face 108B, and creates a curved cut 118C in the cap top 106T. Penetration of the arcuate blade 54 into the container interior 103 also positions the second blade edge 60 perpendicularly to the cap top 106T, which allows the second blade edge 60 to cut in the horizontal direction to extend the curved cut 118.

In a preferred embodiment, the user rotates the container 100 in a rotation direction 66 against the second blade edge 60 to extend the curved cut 118C in a rotational manner until the curved cut 118C forms a complete circle centered around the piercing point 118. While rotating the container 100, the user maintains a steady grip on the drink container piercing device 10 and continually applies the advancing force to overcome the retracting force of the retraction spring 32. Alternatively, in some usage cases, the user may also rotate the drink container piercing device 10 in a direction opposite the rotation direction 66 while also rotating the container 100.

Figure 9:
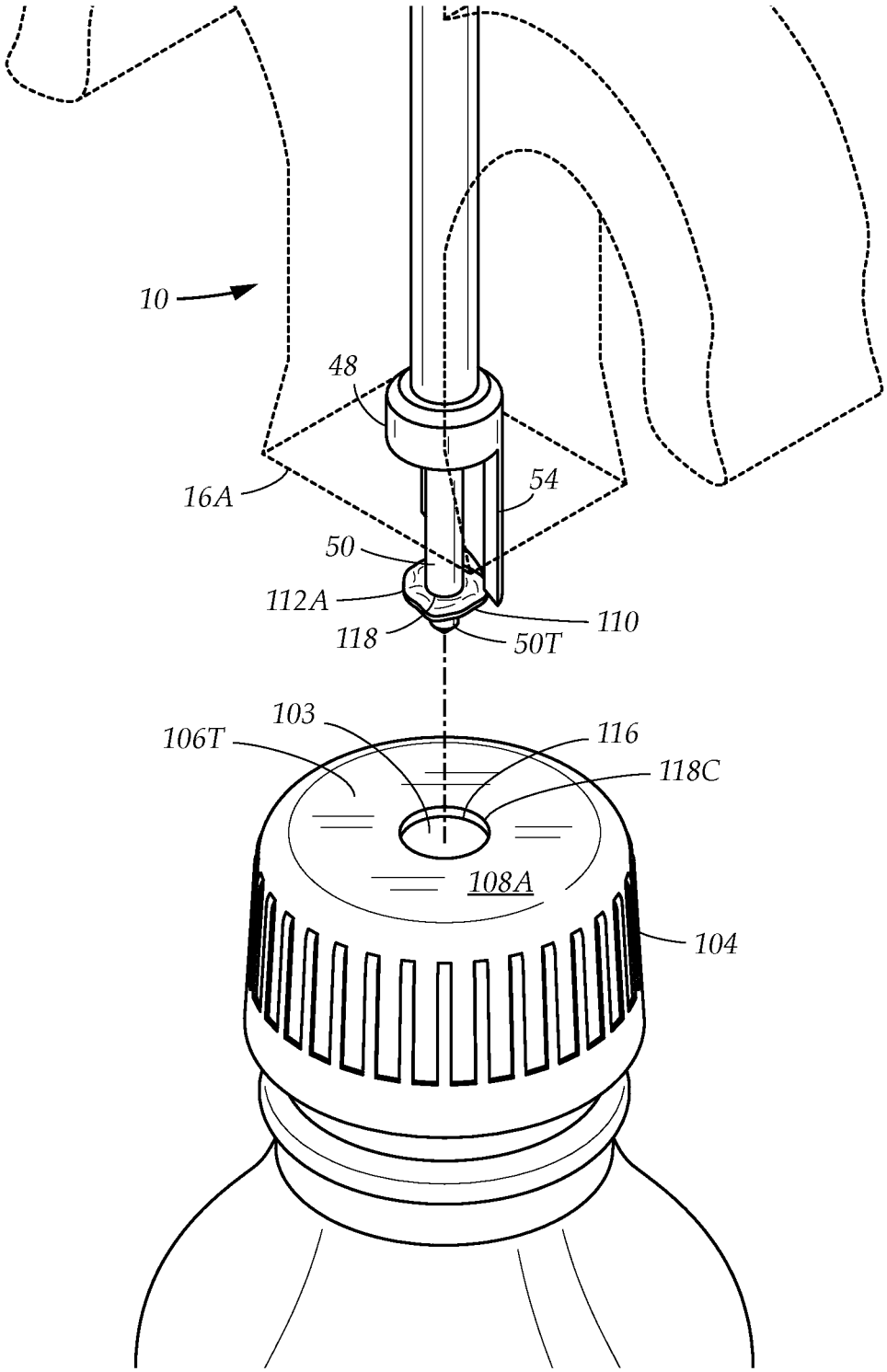
FIG. 9 is a diagrammatic perspective view showing the drink container piercing device being lifted upwardly away from the cap while extracting a cut portion and producing a circular aperture in the cap, in accordance with an embodiment in the current disclosure.

Turning to FIG. 9 and FIG. 10, once the curved cut 118C has been completed, the curved cut 118C forms a cut portion 110 which is circular in shape and comprises material which has been separated from the cap top 106T. The piercing point 118 is positioned centrally through the cut portion 110. The cut portion 110 has a cut portion outer surface 112A oriented towards the device body first end 16A, and a cut portion inner surface 112B oriented opposite thereof. The completion of the curved cut 118C also forms a circular aperture 116 in the cap top 106T surrounding the cut portion 110. The user then separates the device body first end 16A from the cap 104 and withdraws the piercing assembly 48 from the container interior 103.

As the central projection 50 is withdrawn away from the cap top 106T, the cut portion 110 remains attached to the central projection 50, and separates from the cap top 106T to reveal the circular aperture 116. The extraction surface 52 of the central projection abuts against the cut portion inner surface 112B, thereby preventing separation of the cut portion 110 from the central projection 50 and ensuring that the cut portion 110 does not fall through the circular aperture 116 and into the container interior.

Note that in one alternate embodiment, the piercing tip base 50TB may have a diameter which matches the diameter of the central projection 50, thereby omitting the extraction surface 52. The material of the cap 104 may be sufficiently flexible to cause the piercing point 118 to close inwardly around the central projection 50, creating a frictional force which causes the cut portion 110 to remain attached to the central projection 50.

Figure 3A:
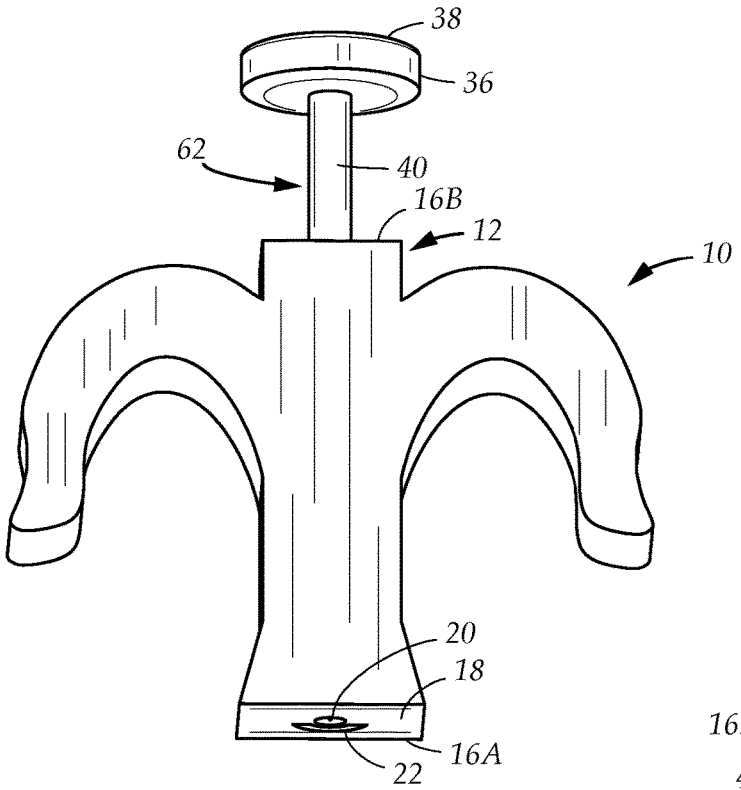
FIG. 3A is a diagrammatic depiction of the drink container piercing device viewed from the front and slightly below, in accordance with an embodiment in the current disclosure.
Figure 3B:
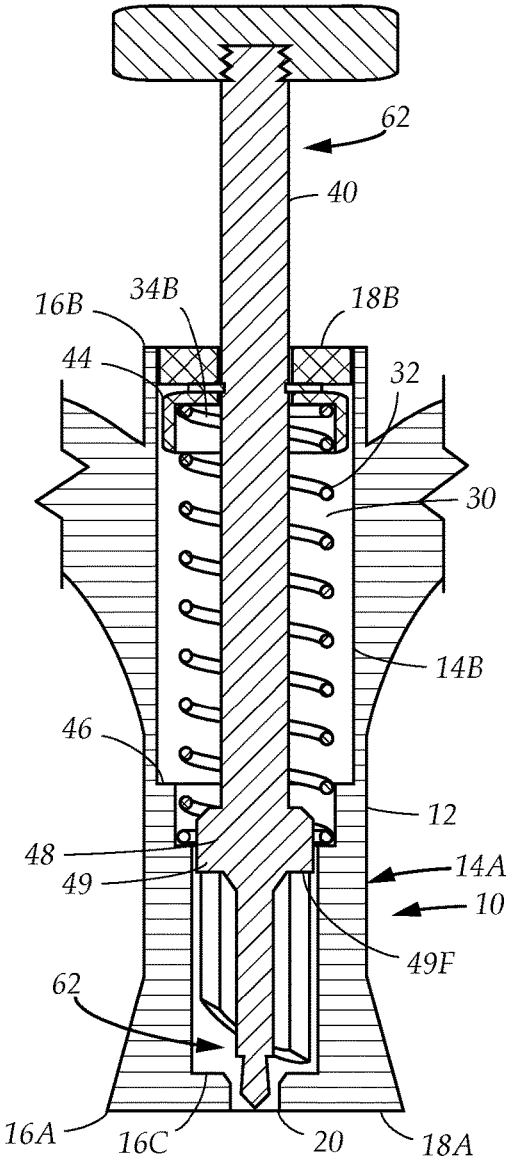
FIG. 3B is a cross sectional view of the drink container piercing device, showing the pushrod and piercing assembly in a retracted position disposed within the interior channel of the device body, in accordance with an embodiment in the current disclosure.

Referring to FIGS. 3A-B while also referring to FIGS. 9-10, the user may release the advancing force exerted upon the pushrod 40, causing the retraction spring 32 to return the piercing assembly 48 to the retracted position. As the central projection 50 is withdrawn into the interior channel 30, the cut portion outer surface 112A abuts against the first surface 18A, pushing the cut portion 110 outwardly past the piercing tip 50T and causing the cut portion 110 to detach from the central projection 50.

Figure 11B:
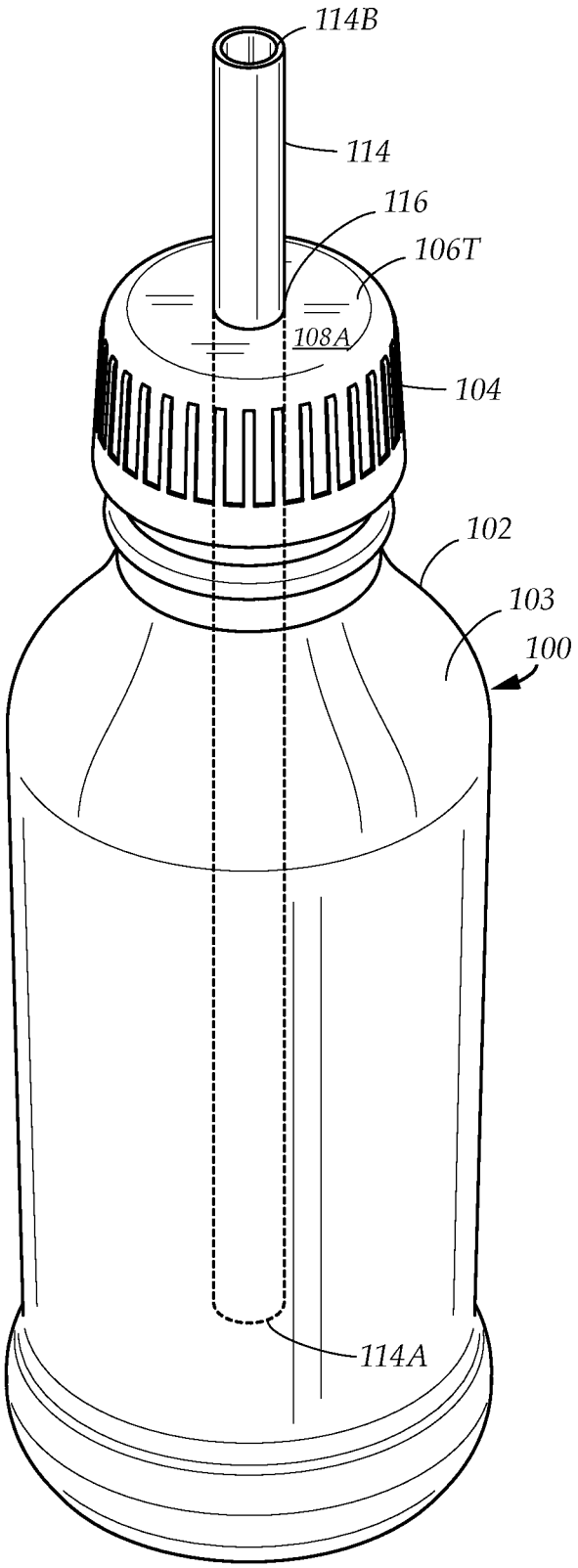
FIG. 11B is a diagrammatic perspective view of the container and a drinking straw, depicting the straw inserted through the circular aperture and into the container interior, in accordance with an embodiment in the current disclosure.

Turning to FIGS. 11A-B while also referring to FIG. 10, the circular aperture 116 provides access through the cap 104 into the container interior 103. The user is able to insert the drinking straw 114 through the circular aperture to consume the contents of the container 100.

In one embodiment, the arcuate blade 54 may be configured such that the circular aperture 116 has a diameter which is substantially equal to the diameter of the drinking straw 114. For example, the arcuate blade 54 may have an arc length, as measured between the first and second sides 56A, 56B, which is sufficient to ensure that the circular aperture 116 has a circumference which is equal to a circumference of the drinking straw 114. The drinking straw 114 is therefore able to form a tight fit with the circular aperture 116 which reduces spillage or leakage of the contents of the container 100. The tight fit may also stabilize the drinking straw 114.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a drink container piercing device. The disclosure is illustrated by example in the drawing figures, and throughout the written description. It should be understood that numerous variations are possible, while adhering to the inventive concept. Such variations are contemplated as being a part of the present disclosure.

What is claimed is:

1. A drink container piercing device for use with a container and a drinking straw, the container comprising a container body and cap, the container body having a container interior for storing contents, the cap having a cap top with a cap top outer face and a cap top inner face, the drink container piercing device comprising:

a device body having a device body first end and a device body second end; and a piercing assembly positioned at the device body first end, the piercing assembly having a central projection and an arcuate cutting blade, the central projection having a piercing tip adapted to penetrate the cap top and create a piecing point which allows the central projection to pass beyond the cap top inner face, the arcuate cutting blade having a first blade edge and a second blade edge, the first blade edge is curved and is adapted to penetrate the cap top from a vertical direction and create a curved cut through which the second blade edge extends, the second blade edge is adapted to cut horizontally across the cap top and extend the curved cut in a rotational manner centered around the central projection to produce a circular cut portion, whereby the central projection is further adapted to retain and extract the circular cut portion from the cap top to produce a circular aperture in the cap top for receiving a drinking straw.

2. The drink container piercing device as described in claim 1, wherein:

the central projection has an extraction surface facing inwardly away from the piercing tip, the extraction surface is adapted to engage the cap top inner face around the piercing point as the cut portion is extracted to produce the circular aperture.

3. The drink container piercing device as described in claim 2, wherein:

the device body has an interior channel extending from the device body first end towards the device body second end; and the piercing assembly is adapted to selectively move between a retracted position and an extended position, whereby the piercing tip of the central projection and the arcuate blade are retracted within the interior channel when the piercing assembly is placed in the retracted position, and the piercing tip and the arcuate blade protrude beyond the device body first end when the piercing assembly is placed in the extended position.

4. The drink container piercing device as described in claim 3, wherein:

the device body has a first surface positioned at the device body first end, the first surface is adapted to be placed against the cap top outer face when the piercing assembly is in the retracted position, the first surface has at least one access aperture allowing the central projection and the arcuate blade to pass therethrough.

5. The drink container piercing device as described in claim 4, further comprising:

a pushrod and a retraction spring, the pushrod is positioned in the interior channel between the piercing assembly and the device body second end, the pushrod having a pushrod first end and a pushrod second end, the pushrod first end is attached to the piercing assembly and the pushrod second end projects outwardly beyond the device body second end, the retraction spring is positioned within the interior channel and exerts a retracting force against the pushrod directed towards the device body second end, causing the piercing assembly to withdraw towards the retracted position, the pushrod allows a user to exert an advancing force against the pushrod second end to overcome the retracting force to advance the piercing assembly into the extended position.

6. The drink container piercing device as described in claim 5, further comprising:

an actuation support positioned at the pushrod second end adapted to support a thumb or palm of the user; and a first finger support and a second finger support, the first finger support and the second finger support project laterally from the device body and allow the user to stabilize the device body by placing a finger against each of the first and second finger supports while the actuation support contacts the thumb or palm of the user.

7. The drink container piercing device as described in claim 6, wherein:

the arcuate blade has a first side, a second side, and a third side, the first and second sides are substantially parallel, and the third side extends laterally between the first and second sides, the first blade edge is positioned along the third side, and the second blade edge is positioned along the first side.

8. The drink container piercing device as described in claim 7, wherein:

the first side of the arcuate blade is longer than the second side, such that the third side and the first blade edge slope angularly from the first side towards the second side.

9. A method for piercing a drink container and preparing the drink container for use with a drinking straw, the container comprising a container body and cap, the container body having a container interior for storing contents, the cap having a cap top with a cap top outer face and a cap top inner face, the method comprising the steps of:

providing a drink container piercing device having a device body with a device body first end and a device body second end, and a piercing assembly disposed at the device body first end having a central projection and an arcuate blade, the central projection having a piercing tip, the device body is adapted to be held by a user;

aligning the device body first end with the cap top by the user;

piercing the cap top upper surface using the piercing tip of the central projection to produce a piercing point, and extending the piercing tip through the piercing point beyond the cap top inner surface;

piercing the cap top upper surface using the arcuate blade to create a curved cut, and extending the arcuate blade through the curved cut beyond the cap top inner surface;

extending the curved cut in a rotational manner centered around the piercing point by cutting across the cap top using the arcuate blade to produce a circular cut portion from the cap top;

withdrawing the piercing tip and the arcuate blade through the cap top upper surface while retaining the circular cut portion with the central projection, and separating the circular cut portion from the cap top to produce a circular aperture; and inserting the drinking straw through the circular aperture to provide access to the contents within the container interior.

10. The method as recited in claim 9, wherein:

the central projection further has an extraction surface facing inwardly away from the piercing tip; and the step of withdrawing the piercing tip further comprises pushing against the cap top inner face around the piercing point using the extraction surface of the central projection.

11. The method as recited in claim 10, wherein:

the piercing assembly is adapted to retract inwardly into the device body towards the device body second end to a retracted position whereby the piercing tip and the arcuate blade are fully contained within the device body, and extend outwardly past the first surface to an extended position; and the step of aligning the device body first end with the cap top is followed by the step of advancing the piercing assembly from the retracted position to the extended position by the user and causing the piercing tip and the arcuate blade to project outwardly past the device body first end.

12. The method as recited in claim 11, wherein:

the device body has a first surface at the device body first end; and the step of aligning the device body first end with the cap top further comprises placing the first surface of the device body against the cap top outer face.

13. The method as recited in claim 12, wherein:

the drink container piercing device further has a pushrod which projects from the device second end for advancing the piercing assembly to the extended position; and the step of advancing the piercing assembly further comprises exerting an advancing force against the pushrod by the user.

14. The method as recited in claim 13, wherein:

the device body has a retraction spring which exerts a retracting force against the pushrod which maintains the piercing assembly in the retracted position; and the step of advancing the piercing assembly comprises exerting an advancing force against the pushrod by the user to overcome the retracting force.

15. The method as recited in claim 14, wherein:

the pushrod has an actuation support positioned distally in relation to the device body, and the device body has a first finger support and a second finger support which project laterally from the device body;

the step of aligning the device body is preceded by the step of grasping the device body by the user, placing a finger of the user against each of the first finger support and the second finger support, and placing a palm or a thumb of the user against the actuation support of the pushrod; and the step of advancing the piercing assembly further comprises stabilizing the drink container piercing device using the first finger support and the second finger support.

16. The method as recited in claim 15, wherein:

the step of extending the curved cut in a rotational manner further comprises rotating the container by the user.

17. The method as recited in claim 15, wherein:

the step of extending the curved cut in a rotational manner further comprises rotating the device body by the user.

18. The method as recited in claim 15, wherein:

the step of withdrawing the piercing tip and the arcuate blade is followed by the step of relaxing the advancing force by the user, retracting the pushrod and the piercing assembly by the retraction spring, contacting the circular cut portion with the first surface, pushing the circular cut portion towards the piercing tip by the first surface, and detaching the circular cut portion from the central projection as the piercing tip retracts inwardly past the first surface.

* * * * *